United States Patent [19]

Connelly

[11] Patent Number: 4,867,445

[45] Date of Patent: Sep. 19, 1989

[54] RESISTANCE-TYPE EXERCISE APPARATUS

[75] Inventor: Richard E. Connelly, Jeromesville, Ohio

[73] Assignee: Richard E. Connelly Co., Inc., Ashland, Ohio

[21] Appl. No.: 837,220

[22] Filed: Mar. 7, 1986

[51] Int. Cl.[4] ..... A61H 21/22; A61H 21/32

[52] U.S. Cl. ..... 272/130; 272/134; 272/141; 272/900

[58] Field of Search ..... 272/130, 67, 72, 116, 272/132, 135, 141, 144, 134, 900; 128/25 R

[56] References Cited

U.S. PATENT DOCUMENTS

| | | | |
|---|---|---|---|
| 2,865,633 | 7/1956 | Woodall | 272/130 X |
| 2,959,414 | 6/1958 | Saltz | 272/900 X |
| 3,884,463 | 5/1975 | Malatesta | 272/130 |
| 4,227,689 | 10/1980 | Keiser | 272/130 |
| 4,254,950 | 3/1981 | Baumann | 272/130 |
| 4,257,593 | 3/1981 | Keiser | 272/130 |
| 4,275,882 | 6/1981 | Grosser et al. | 272/130 X |
| 4,426,077 | 1/1984 | Becker | 272/130 X |
| 4,429,871 | 2/1984 | Flechner | 272/130 |
| 4,478,412 | 10/1984 | Muir | 272/130 |
| 4,621,809 | 11/1986 | Pearl | 272/144 X |
| 4,651,719 | 3/1987 | Funk et al. | 128/25 R |

*Primary Examiner*—Richard J. Apley
*Assistant Examiner*—David J. Bender
*Attorney, Agent, or Firm*—D. Peter Hochberg; Mark M. Kusner; Louis J. Weisz

[57] ABSTRACT

Exercise apparatus including an arm pivotally mounted on a base, a fluid actuator carried by the arm and having a piston drive by an arm also pivotally mounted on the base, and a member for rotating the arm to move the piston against force resulting from fluid pressure applied to the piston.

6 Claims, 14 Drawing Sheets

RESISTANCE-TYPE EXERCISE APPARATUS

BACKGROUND OF THE INVENTION

This invention relates to exercise apparatus, and in particular to resistance-type exercise apparatus for exercising a person's muscular system.

The benefits of exercising the human muscular system are widely known and accepted. Persons in all walks of life, of virtually all ages, of both sexes, of many conditions of health, of many degrees of athletic ability, of all degrees of physical fitness and for a variety of reasons engage in many exercises to maintain or improve their strength, flexibility, endurance, appearance and attitude. The widespread interest in exercise programs has led to the development of many types of exercise equipment. One type of equipment is weight lifting apparatus. Weight lifting apparatus includes barbells, dumbbells and similar dead weight systems. In order to facilitate the variety of exercises which can be performed, the so-called universal gyms have been developed. These systems are self-contained units having different exercise stations with variable weight loads at various stations for exercising different muscular groups. Despite the benefits of dead weight systems, they have been criticized because the load is fixed through the range of many exercises. Thus, a 100 pound weight exerts a load of 100 pounds at all times, which could place an undue load on particular muscle groups during parts of an exercise and an inadequate load at other parts of the exercise. In view of this criticism, various systems have been developed which vary the load of a particular weight during a particular exercise by means of cams, cables, pulley systems, linkages and the like.

The foregoing weight systems are widely used in gymnasiums, weight rooms and the like where the systems are set up as permanent installations for use by numerous persons. However, since these systems are heavy, bulky and often include a number of separate units, they are unsuitable where space limitations exist or where portability is a requirement. Thus, such systems are not used in homes, for example. However, various exercise systems have been developed for home use. One type of home exercise system is sometimes referred to as an exercise machine. These exercise machines usually include a bench with a column at one end from which extends a movable, adjustable arm. A variable load is connectable to the arm, and the user can stand in different positions or lie on the bench and perform different exercises. Sometimes a leg exercise device is also attached to the bench for performing leg curls and leg extensions. Such exercise machines are used in many homes, but they are too large to be moved about and cannot easily be put away for temporary storage when not in use.

The weight systems now in wide use are heavy, requiring associated support equipment such as benches and support racks to have commensurate strength and rigidity. As a consequence, numerous resistance-type exercise apparatus have been developed. There are numerous examples of exercise equipment incorporating springs, elastic bands and straps, and fluid devices for providing a resistance load. Some of the exercise apparatus discussed above, such as the exercise machines, use resistance loads rather than weight loads.

Despite the extensive effort which is being made to develop effective exercise equipment, there has heretofore not been developed a compact, portable exercise apparatus for performing a wide variety of exercises using a range of loads including heavy loads. There is nothing available for travelers to carry with them for following a full exercise program. Weight systems are clearly not portable. Exercise machines of the weight type and of the resistance type are much too big and heavy to be transported by the traveler. The few portable devices include various springs with handles, but these enable the performance of but a few exercises and then at very low loads. Similarly, there are no compact, light devices which can be used for a full exercise program and which can be put away easily when not in use. There is a great need for such devices for use in homes including apartments where space is limited, medical care institutions, hotel rooms, offices and the like.

SUMMARY OF THE INVENTION

It is an object of the invention to provide a light, compact exercise device which can be used to perform a variety of physical exercises.

It is another object to provide an exercise device which is compact and light, yet capable of providing a range of loads including heavy loads to the user of the device.

A further object of the invention is to provide a portable exercise device for enabling the performance of a variety of physical exercises.

Yet another object of the invention is to provide a portable exercise device for performing various exercises without requiring special installation to ready the device or use.

Yet a further object of the invention is to provide a versatile exercise apparatus which can be used for a variety of exercises over various ranges of movement without requiring complicated or time consuming adjustment.

It is an additional object to provide a versatile exercise apparatus which can be stored easily.

A further object is the provision of compact exercise apparatus which does not require special support equipment to enable use of the apparatus.

Another object is the provision of a compact and versatile exercise apparatus which can be adjusted for different loads easily and quickly.

A further object of the invention is to provide an exercise system in which a compact and light resistive force generating apparatus can be selectively mounted at different locations on support structure to enable a user to exercise different muscles in the body.

It is also an object to provide exercise apparatus readily usable by incapacitated persons who are confined to beds, wheelchairs and the like.

It is still another object of the invention to provide a light, compact, versatile exercise apparatus which is practicable and economical to manufacture.

An additional object is to provide a light, compact, versatile exercise apparatus which is durable, effective in use, and easy and safe to use.

Other objects will be apparent from the description to follow and from the appended claims.

The foregoing objects are achieved according to the preferred embodiments of the invention by the provision of exercise apparatus comprising a base, a first arm mounted for rotation on the base about a first axis of rotation and a fluid actuator carried by the first arm for resisting movement of the first arm. A second arm is attached to the first arm for extending the first arm, the second arm being foldable for storage. A third arm is pivotally attached to the second arm and carries a handle to be gripped by the user of the apparatus. The distance from the handle to the axis of rotation of the first arm determines the moment arm or effective length of the first arm, and varies with the length of the arm of the user in the case of exercises performed by gripping the handle. The fluid actuator includes a flexible air bag having a sealed chamber containing a quantity of pressurized air which can be varied by injecting air into the bay or releasing air therefrom through an air valve. A piston at one end is movable in the chamber by means of a piston rod pivotally attached to the base at one end and to the piston at the other end. The relationship of force to movement can be controlled by controlling the shape of the piston, and the piston preferably is configured as a truncated cone having a negative slope (i.e. the size of base which interfaces with the bay exceeds its opposite end attached to the connecting rod) to yield a uniform resistive force throughout the operating range of the arm. Various support structure for the exercise apparatus provide great versatility to the apparatus, by creating an exercise system in which individual units of pairs of the exercise apparatus can be mounted at different locations on the support structure to enable a user to perform many exercises. Such support structure includes members to be placed on the ground and stood on or lied upon by the user, wall mounted support structure, support structure to be placed beneath a person lying in bed, and wall mounted structure having a configuration against which a wheelchair can be backed.

BRIEF DESCRIPTION OF THE DRAWINGS

FIG. 3 shows the apparatus in a folded condition.

FIGS. 21 and 22 show the initial and full compression stages of the exercise and FIG. 23 shows the system in perspective.

DETAILED DESCRIPTION OF THE PREFERRED EMBODIMENTS

Figure 2:
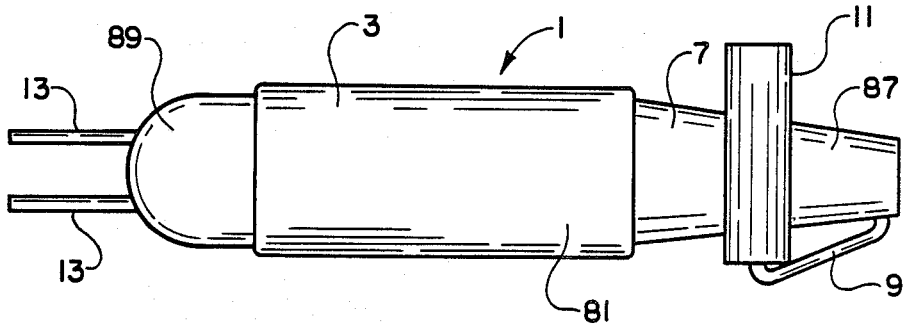
FIGS. 1, 2 and 3 are side, top, and perspective views respectively, of exercise apparatus according to the preferred embodiment of the invention.
Figure 3:
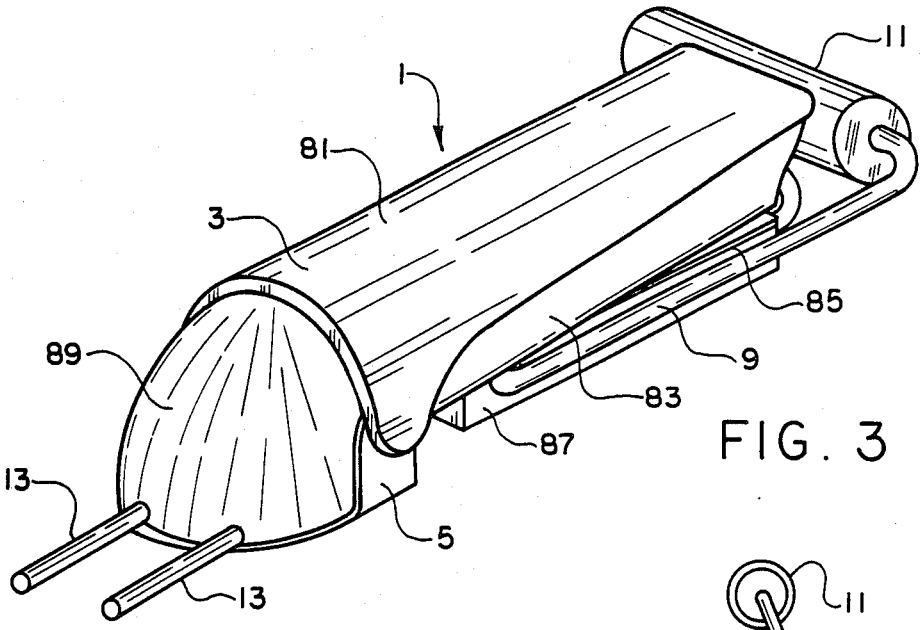
Figure 1:
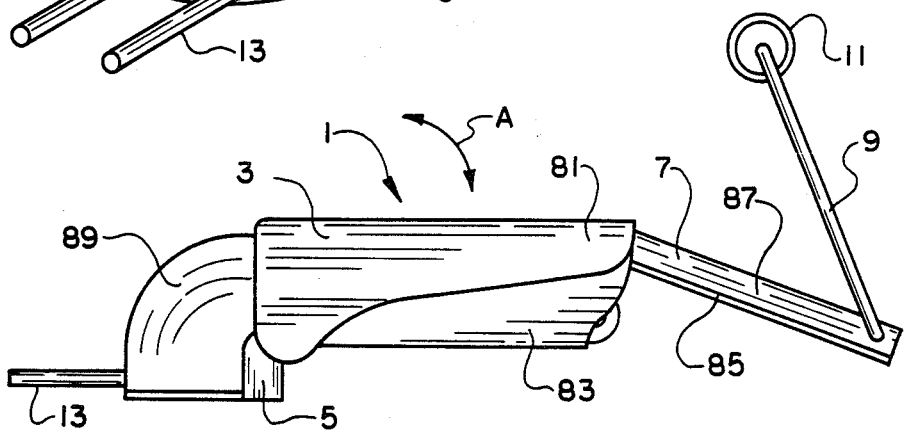

Referring to the drawings, and in particular to FIGS. 1–3, an exercise apparatus 1 according to the preferred embodiment of the invention is shown. Apparatus 1 includes a first arm 3, which is mounted for pivotal movement on a base 5. First arm 3 comprises a housing for covering various components of apparatus 1 as described in detail below. A second arm 7 is pivotally attached to first arm 3, and a third arm 9 is pivotally attached to second arm 7. A handle 11 forms part of third arm 9. A pair of mounting pins 13 extend from base 5 for mounting apparatus 1 on some other body as described later. In use, a person grips handle 11 and rotates first arm 3 through an angle of up to 90° in the direction of arrow A from the rest position shown in FIG. 1, against the resistance of the fluid actuator described below, to achieve the desired exercise.

Turning next to FIGS. 4–7, in which the housing of first arm 3 has been removed, the inner workings of apparatus 1 are shown. First arm 3 includes a pneumatic actuator 15 which is preferably an Airsleeve actuator. The latter apparatus is manufactured by Firestone and has heretofore been used as a load cushioning device in heavy vehicular equipment. Actuator 15 has a base which is fixed against a stop plate 17, stop 17 itself being fixedly mounted within first arm 3. Actuator 15 further includes a rolling sleeve or air bag 19 sealed at the base of actuator 15 and at its opposite end where it is attached in an airtight manner to a piston or plug 21, to define an airtight container or chamber. Plug 21 is in the form of a truncated cone having a wide base portion to which bag 19 is attached, and a narrower opposite end which is attached to a movable piston rod 23 through the intermediary of a mounting plate 25. The attaching end of piston rod 23 is threaded and a nut 27 locks the connection between rod 23 and threaded plug 21. Actuator 15 is located between a pair of guide rods 29 which are formed at one end in the shape of an inverted "U" as shown at 31 engage stop plate 17 to fix plate 17 and rods 29. A stop bar 33 is provided to the left of mounting plate 25 to limit the leftward movement of plate 25 and hence of piston 21. Thus, piston 21 is confined to a path of movement between stops 17 and 33. Actuator 15 includes an air fill release valve 34 which is preferably located at the central end of the base of the actuator, and accessible through an opening in stop plate 17.

Piston rod 23 is pivotally mounted at its end opposite piston 21 to a first axle 35 which is fixed on base 5. Guide rods 29 are pivotally mounted on a second axle 37 which also is fixed on base 5. Axles 35 and 37 are thus offset from each other. Rods 29 are held in place in first arm 3 by pin 37. A holding member shown as a plate 38 is held in place by rods 29 and serves to hold the covers for first arm 3 as discussed below.

Second arm 7 is shown as comprising a pair of side rods 39 which are inclined towards each other from their connection to first arm 3. Second arm 7 includes a pair of transverse legs 42. Arm 7 terminates at the ends of legs 42 in loops 43 which wrap around a hinge pin 44. In this manner, arm 7 is pivotally attached to first arm 3. Alternatively, referring to FIGS. 6 and 7, a pair of nodes 45 can be provided at opposing portions of section 31 of guide rods 29, and legs 42 of rods 39, can be bent as shown at 47 so that legs 42 fit between the upper ones of nodes 45 and plate 17 to rotatably mount arm 7 on first arm 3. As discussed later, the ends of rods 39 can be moved so that legs 42 fit between the pairs of nodes 45 to fold the apparatus. Second arm 7 includes a cover as noted below.

Figure 5:
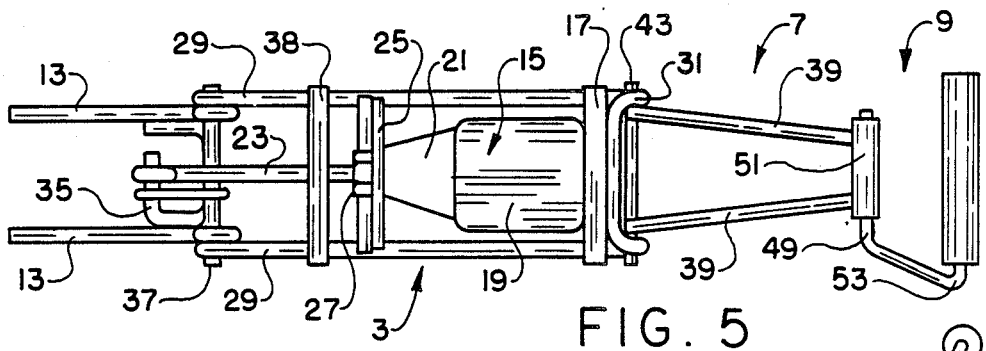
FIGS. 4 and 5 show side and top views, respectively, of the apparatus of FIGS. 1–3, with the cover structure removed.
Figure 4:
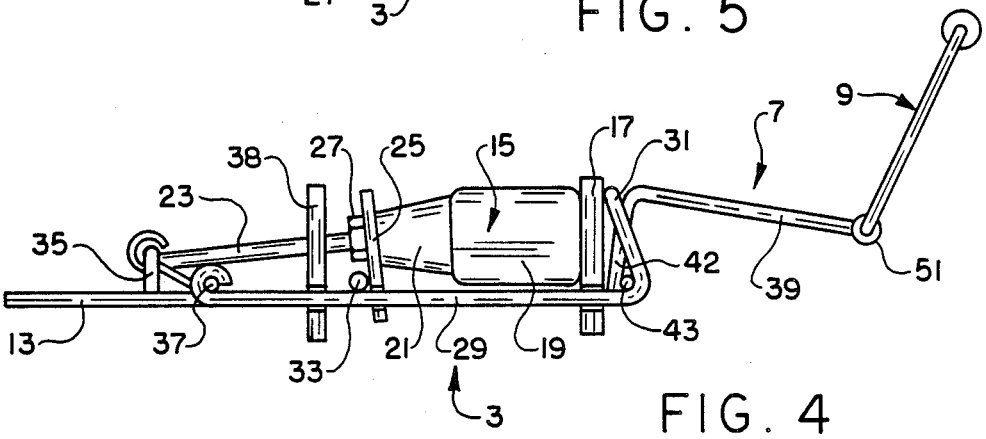

Still referring to FIGS. 4 and 5, third arm 9 is in the form of a crank, and includes a cross member 49 which extends into a bushing 51 attached to the ends of rods 39 of second arm 7 and a handle 53 parallel to cross member 49. A hand grip such as a tubular piece of plastic foam is attached to handle 53 to enable a user to grasp handle 53 with ease and comfort. A cotter pin or the like can extend through a bore at the free end of cross member 49 to retain third arm 9 in bushing 51.

Figure 8:
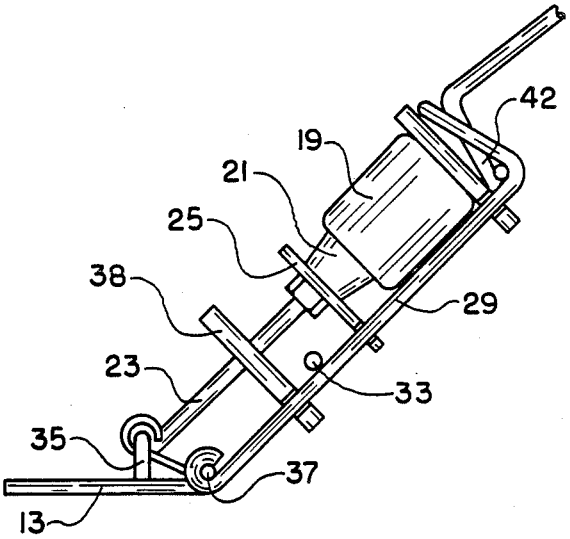
FIGS. 8 and 9 show the apparatus of FIGS. 4 and 5 during the intermediate and final stages of its range of movement from a rest position shown in FIGS. 4 and 5.
Figure 9:
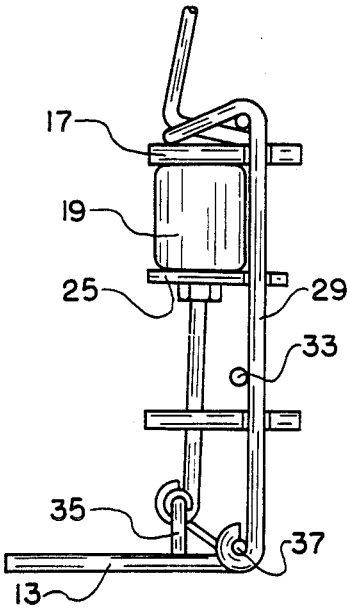
Figure 6:
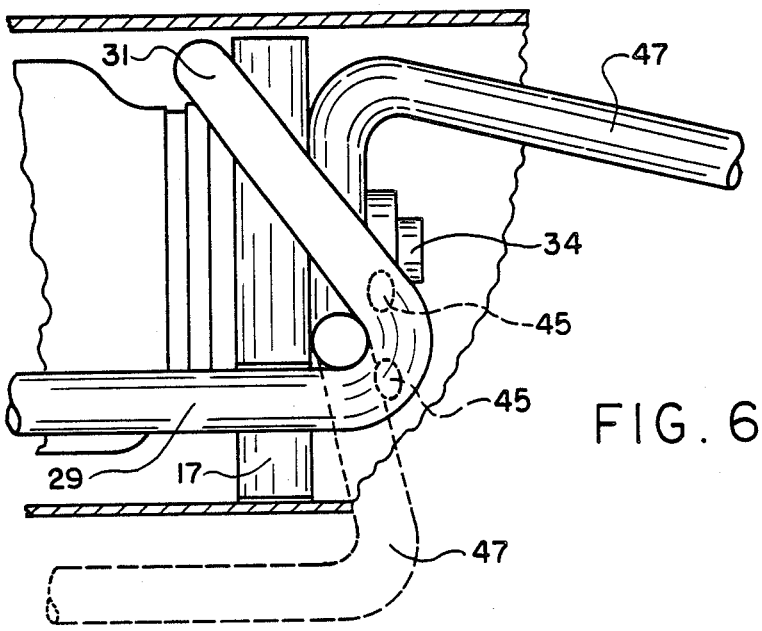
FIGS. 6 and 7 are detailed top and end views of the juncture of the first and second arms of the apparatus shown in the preceding figures.
Figure 7:
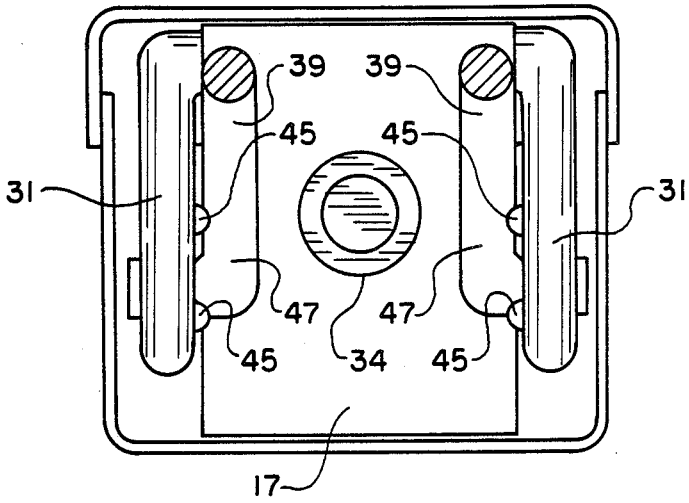

The operation of apparatus 1 can be seen from FIGS. 4, 8 and 9. Apparatus 1 is shown in its rest position in FIG. 4. Mounting plate 25 is located against stop bar 33, and piston 21 is at its maximum extension from bag 19. Second arm 7 is in general alignment with first arm 3. When the user grasps handle 53 and rotates second arm 7 (via the movement of third arm 9) to a transverse or raised position as shown in FIG. 8, guide rods 29 pivot first arm 3 about axle 37, and piston rod 23 drives piston 21 into bag 19 because the radial distance between piston 21 and its rotational axis 35 is greater than aligned locations on arms 29 and the rotational axis 37 of first arm 3. FIG. 8 shows that mounting plate 25 has been moved away from stop bar 33, and the overall volume of bag 19 has decreased to compress the air therein by virtue of the movement of piston 21 into bag 19, and the bag has partially enveloped piston 21 as well.

The apparatus assumes the configuration shown in FIG. 9 when the rotation of second arm 7 has rotated first arm 3 to the end of its 90° range. Piston rod 23 has driven mounting plate 25 towards stop 17 and the air in bag 19 is at full compression. At this time the user would normally return apparatus 1 to the rest position of FIG. 1. The return movement would require the user to resist the force resulting from the pressure of the air within bag 19 against the projected surface of the piston urging second arm 7 to its rest position. Thus, there is a negative resistance to the user. The apparatus includes a driving means for driving piston 21 into airbag 19 to change the fluid pressure therein; the driving means comprises first arm 3, second arm 7 and piston rod 21.

Figure 10:
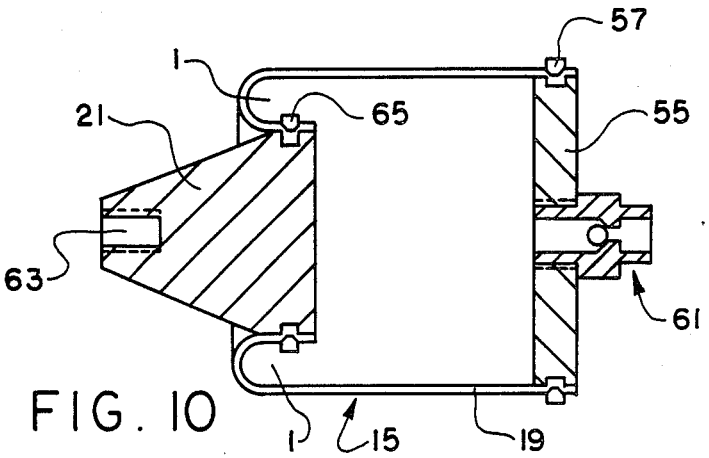
FIGS. 10 and 11 are cross sectional views of the fluid actuator of the illustrated embodiment at intermediate and full compression phases of a cycle of operation of the actuator.
Figure 11:
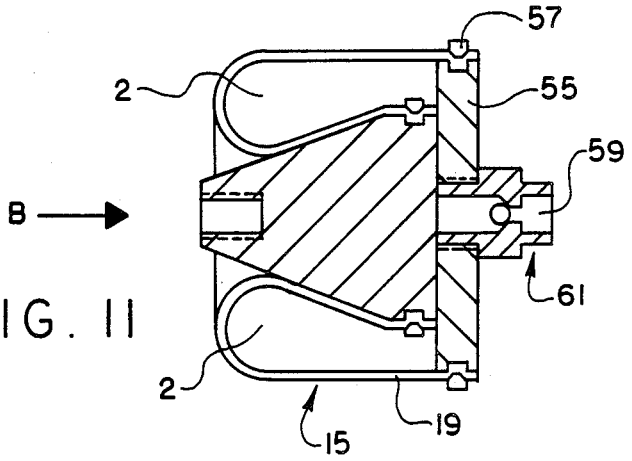
Figure 12:
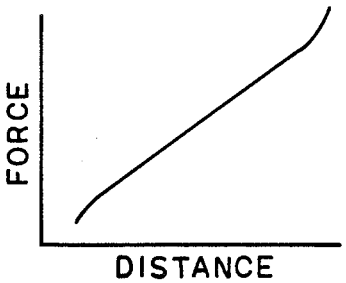
FIG. 12 is a graph showing the relationship of force with the distance of movement of a piston of the fluid actuator over the range of travel for a piston configured to yield a linear force response.
Figure 13:
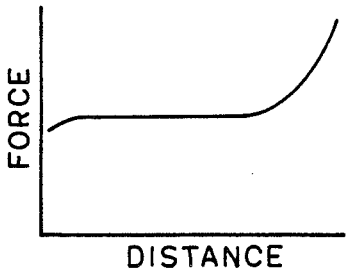
FIG. 13 is a graph showing the relationship of force with the distance of movement of a piston for a piston configured to yield a linear force response over part of its operating range of travel and a non-linear response at the ends of that range.

The functioning of the fluid actuator is shown in further detail in FIGS. 10 and 11. Actuator 15 can be seen to comprise a tubular flexible sheet constituting bag 19. Actuator 15 includes a base plate 55 on whose peripheral edge the end of bag 19 is hermetically sealed by a band 57 which compresses the bag against plate 55. A bore 59 in the center of base 55 holds air valve 61 into which air can be injected with a conventional air pump or released through actuation of a release valve member. Piston 21 is shown as a truncated cone having a threaded, blind bore 63 into which the threaded end of piston rod 23 can be threaded. The end of bag 19 is hermetically sealed against piston 21 by means of a band 65 which functions in the manner of band 57. During the compression mode of apparatus 1, piston 21 is driven towards base plate 55 as indicated by arrow B from the position of FIG. 10 to that of FIG. 11 to drive bag 19 from a relatively expanded condition to a relatively collapsed condition wherein the bag is collapsed within itself. During such movement, bag 19 does not expand appreciably (and need not expand at all), but the air within the bag is compressed. Such compression is accompanied by an increase in the air pressure within bag 19, but the force resisting piston 21 does not necessarily vary in direct proportion with the increase in air pressure. Since the resistive force is a function of both the air pressure and the area against which that air pressure is applied, the configuration of piston 55 can be used to regulate that resistive force. If piston 21 were a cylindrical member, the resistive force would increase as the air within bag 19 were compressed as shown in FIG. 12 because the area against which the air pressure was applied would remain constant. However, if piston 21 has a negative slope as shown in FIGS. 10 and 11, the force does not increase proportionately with the increasing air pressure, but could be caused to remain constant over a predetermined operating range of movement as shown in the central part of the curve in FIG. 13 or to bear some other relationship with the change of the pressure of the air within bag 19. Piston 21 has been selected so that the effective area against which the resistive pressure component of the compressed air is applied decreases with increasing force so as to achieve a substantially constant resistive force, which is often desired for exercise equipment.

Figure 14:
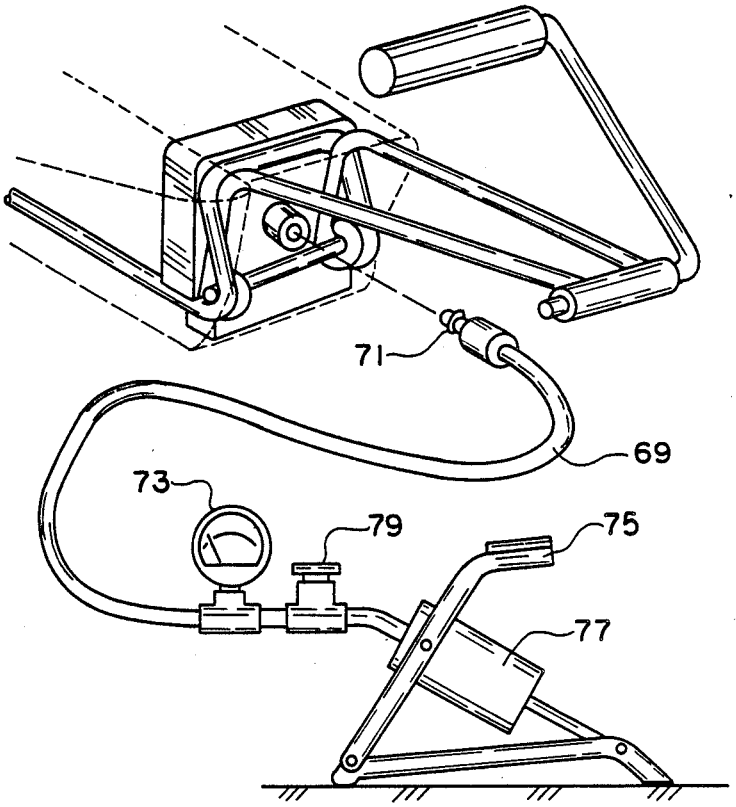
FIG. 14 is a perspective view of the apparatus shown in the preceding figures having an air pump connected to the actuator for injecting air into the actuator.
Figure 15:
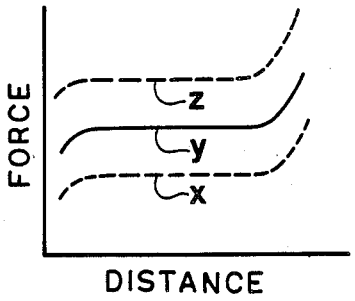
FIG. 15 is a graph showing the variation of resistive force with air pressure in the actuator for different initial pressure values.

One of the main advantages of the invention is the control available to the resistive force to piston 21. Such control is achievable through variations in the initial pressure within bag 19, and through the configuration of piston 21 as discussed above. Air is injected into actuator 15 by means of a conventional air pump. Referring to FIG. 14, a conventional foot-operated air pump 67 having an air hose 69 to which is connected an air needle 71 for insertion into valve 61. An air gauge 73 indicates the pressure in actuator 15. Air is forced into actuator 15 (here a pneumatic actuator) by depressing a pedal 75 to reciprocate a piston in a cylinder 77, and air is released from actuator 15 by depressing a release button 79. Of course, other air pumps and air release devices could be used. FIG. 15 shows three curves x, y and z demonstrating the resistive force for a piston 21 configured as shown in the drawings, for initial air pressures of increasing magnitude in actuator 15. The shape of the resistive force curves can be changed to vary over the operating range, to remain constant, etc. according to the configuration of the piston as noted above. The resistive force is infinitely variable over its operating range.

It is desirable to cover the components of apparatus 1 which are illustrated in FIGS. 4, 5, 8 and 9. Referring back to FIGS. 1–3, first arm 3 further includes a housing composed of a formed plastic cover 81 which fits partially over a formed plastic under cover 83. Similarly, second arm 7 is provided with a housing composed of a flat under cover member 85 and a formed cover 87 for enclosing the rods and bushing of the second arm. A protective cover such as a foam elbow 89 covers the portions of the elements constituting the juncture of first arm 3 and support 5. The foregoing covers protect the enclosed members and persons and things which might contact those members, facilitate the cleaning of the apparats, and add to its appearance.

FIG. 3 demonstrates the manner in which apparatus 1 can be folded for storage and transportation. Thus, second arm 7 can be rotated about hinge pin 43 (or any other axis of rotation such as between nodes 45) to fit beneath and against first arm 3. Since the base of first arm 3 is recessed, arm 7 fits within the recess. Similarly, third arm 9 an be rotated about cross member 49 to render arm 9 generally coplanar with arm 7. The rotatable feature 7 is provided to render apparatus 1 collapsible. If this feature were not desired, arm 7 could be dispensed with and arm 3 extended in length to the desired length.

The pivotable construction of arm 9 has the effect of enabling a single apparatus to be custom fit for persons of all sizes, since the user selects the moment arm between handle 11 and the axis of rotation about axle 37 by establishing the angle between arms 7 and 9 (or arms 3 and 9). Since arm 9 is freely rotatable, virtually no effort is required to establish the length of the moment arm.

Apparatus 1 can be used in a great variety of ways, either alone or in cooperation with a like apparatus. Some examples of this variety of uses are discussed below.

Figure 16:
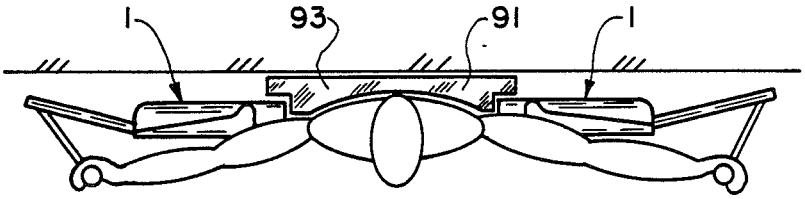
FIGS. 16 and 17 are top views of a person performing fly exercises on a wall mounted exercise system according to a preferred embodiment of the invention at the rest and full compression of the exercise operation.
Figure 17:
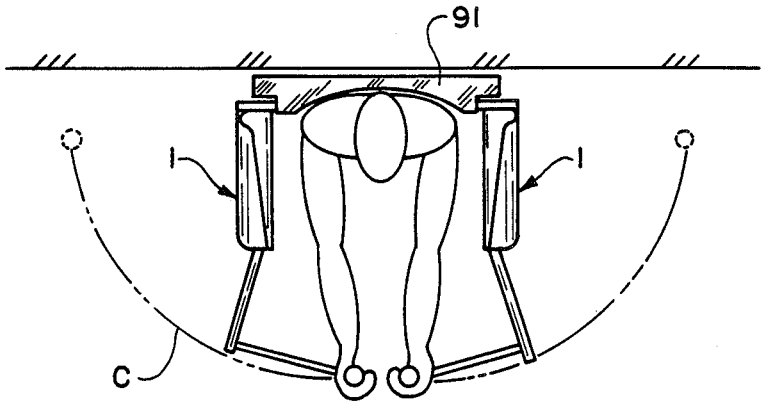
Figure 18:
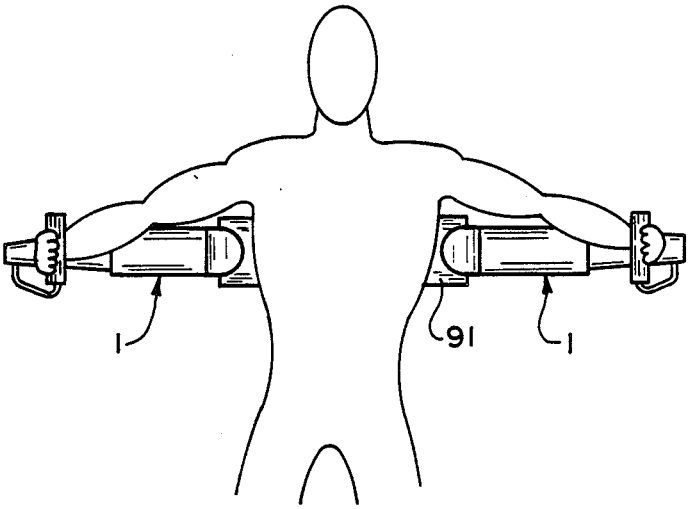
FIG. 18 is a front view of the arrangement shown in FIG. 16.

Apparatus 1 can be mounted in tandem on a wall support unit 91 as shown in FIGS. 16–18, having receptacles for receiving mounting pins 13. When so mounted, the user can stand with his back against wall unit 91 and grip handles 53. Unit 91 is preferably contoured to receive a person's back as shown at 93. He can rotate apparatus 1 about vertical axis from the rest position of FIGS. 16 and 18, to the final position of FIG. 17 through the path shown by dotted lines C, where piston 21 is fully inserted into airbag 19.

Figure 19:
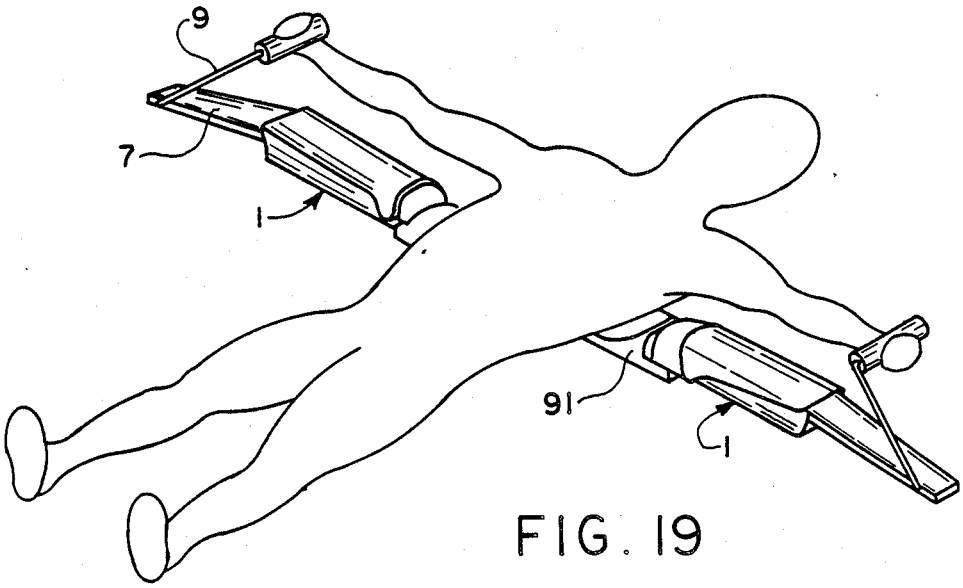
FIGS. 19 and 20 show an exercise system according to the invention set up for performing fly exercises on the ground, with a person doing such exercises.
Figure 20:
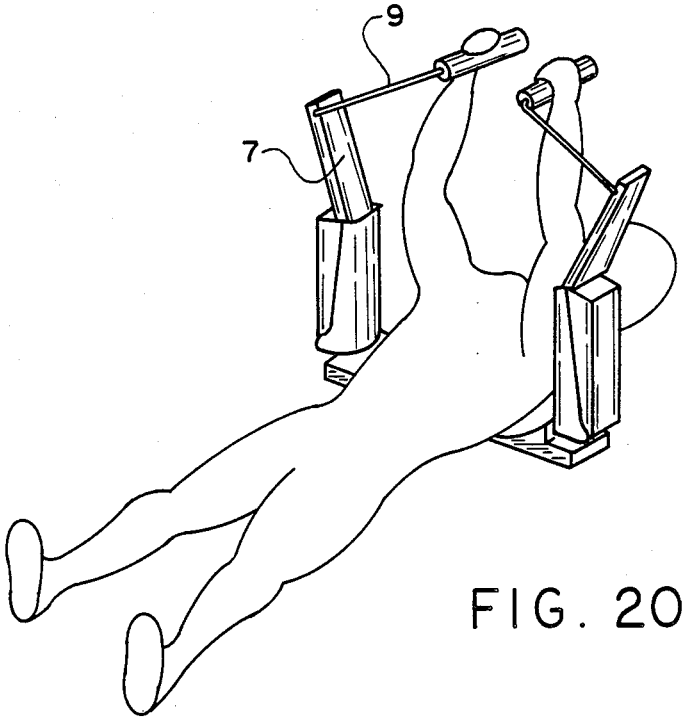

Apparatus 1 can easily be used to perform a fly exercise on the floor as shown in FIGS. 19 and 20. Again, support 91 can be used for this purpose. Support 91 thus can be removably attachable to an appropriate wall bracket, and adaptable to lie flat on the floor. The user can lay on unit 91 as shown, and rotate the respective apparatus 1 between the rest position of FIG. 19 and the final position of FIG. 20. FIGS. 19 and 20 demonstrate the universal length of adjustment of the apparatus, which is established by the angle between arms 7 (or 3) and 9. Upon completion of the exercise, the user can easily remove each apparatus 1, fold it as shown in FIG. 3, and store the equipment with support 91.

Figure 21:
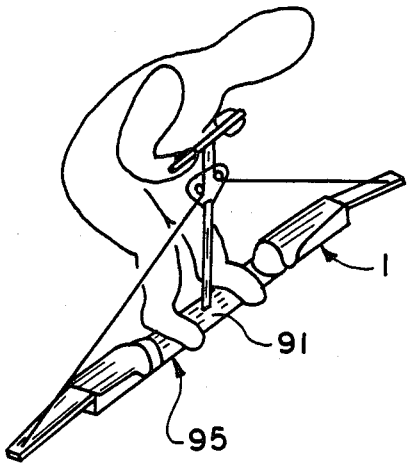
FIGS. 21, 22 and 23 show an exercise system according to an embodiment of the invention incorporating a cable apparatus for performing a standing row exercise.
Figure 22:
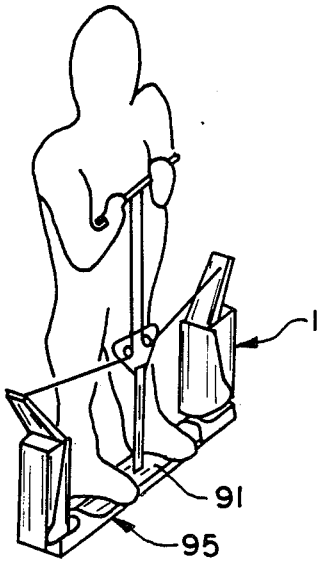
Figure 23:
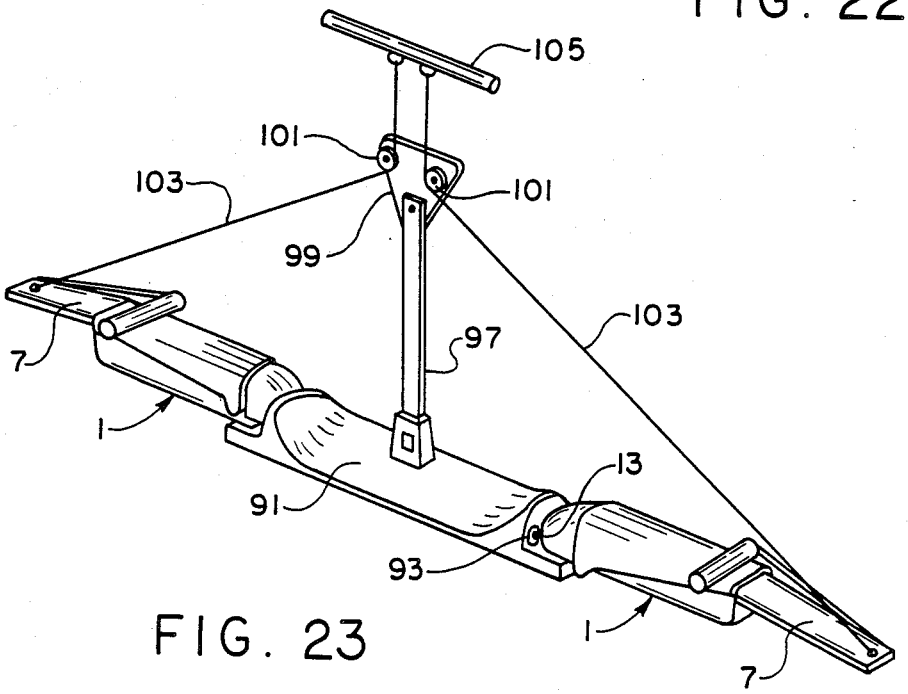
Figure 24:
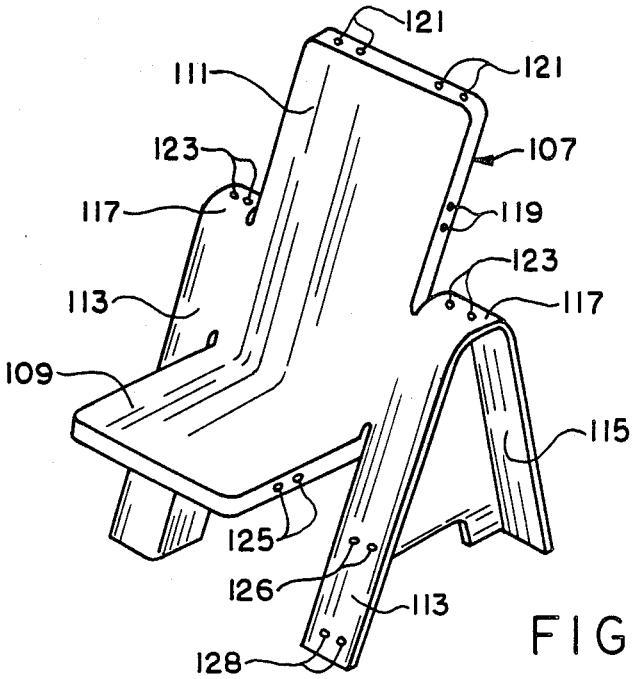
FIG. 24 shows in perspective support structure in the form of a chair for receiving a pair of exercise apparatus, pursuant to another embodiment of the invention.

Apparatus 1 can be used with a cable assembly to perform rowing and many other exercises. Turning to FIGS. 21–23, a pair of exercise apparatus 1 are shown mounted on a support 91 by means of pins 13 inserted in receptacles 93. A cable mechanism 95 is mounted by some appropriate connecting mechanism to support 91. Cable mechanism 95 includes a strap 97 which can be rigid or flexible, a pulley support plate 99 on which are mounted a pair of pulleys 101, and cables 103 extending from second arms 7 to which they are attached by means of an appropriate coupling around pulleys 101 and to a handle 105. To perform the rowing exercise from the standing position, the user can stand on support unit 91, bend over and grasp handle 105 as shown in FIG. 21, and move to the vertical position while lifting handle 105 to move each apparatus 1 from the rest position of FIG. 23, against the resistance of actuator 15 to the final position of FIG. 22.

The great versatility of apparatus 1 is further demonstrated in FIGS. 24–28. These figures show the manner in which a chair 107 constructed to receive apparatus 1 in a variety of locations can serve as a compact, light and economical vehicle for effectively enabling a user to provide a wide range of exercises in a controlled and effective way. Chair 107 includes a seat 109, a back 111, a pair of front legs 113 and a pair of rear legs 115, the respective front and rear legs converging at their upper portions to define a pair of leg junctures 117. Opposing pairs of cylindrical bores or receptacles, dimensioned to receive mounting pins 13 of exercise apparatus 1, are provided at 119, 121, 123, 124 and 125 to mount apparatus 1 at various locations on chair 107. Through the simple act of mounting apparatus 1 in the respective receptacles, one can perform the full range of exercises heretofore possible only with individual exercise apparatus designed for individual exercises or with heavy and costly exercise machines.

Figure 25:
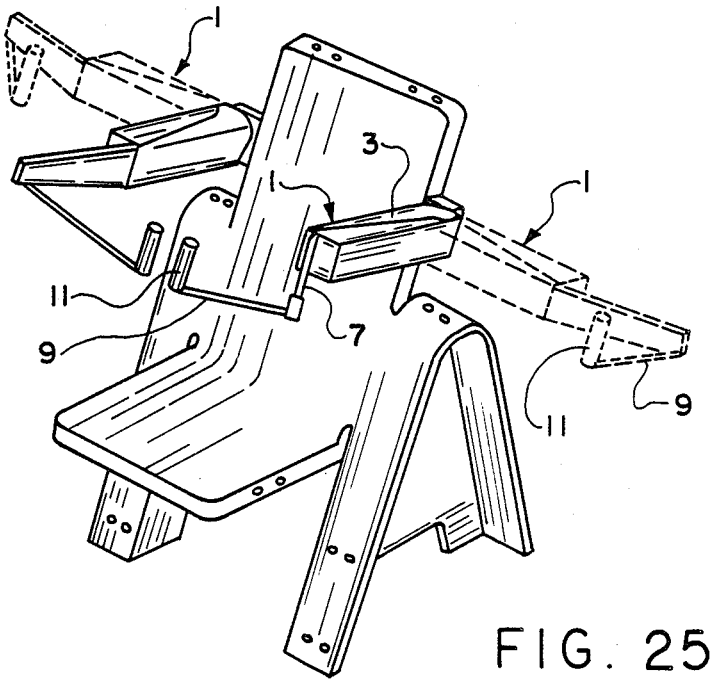
FIGS. 25–30 are perspective views of exercise apparatus mounted in different positions on the chair of FIG. 24.

FIG. 25 illustrates the manner in which apparatus 1 can be assembled on chair 107 to perform the seated fly exercise, which is a standard exercise for the pectoral muscles. Mounting pins 13 of a pair of exercise apparatus 1 are inserted in receptacles 119 so that first arms 1 extend laterally from chair back 111. The user sits on seat 109 in the conventional manner with his back resting against back 111. The user grasps each handle 11, bending third arms 9 according to his arm length, and rotates first arms 3 from the lateral, rest position shown in dotted lines, to the forward position shown in solid lines, and reverses and repeats this process as desired. As first arms 3 are rotated from the lateral position to the forward position, the user must overcome the resistive force of actuator 15 to obtain the desired positive or forward exercise. Likewise, there is a bias urging arms 3 to the lateral position, which is a negative resistance which the user resists to thereby afford the exercise for the pectoral muscles.

Figure 26:
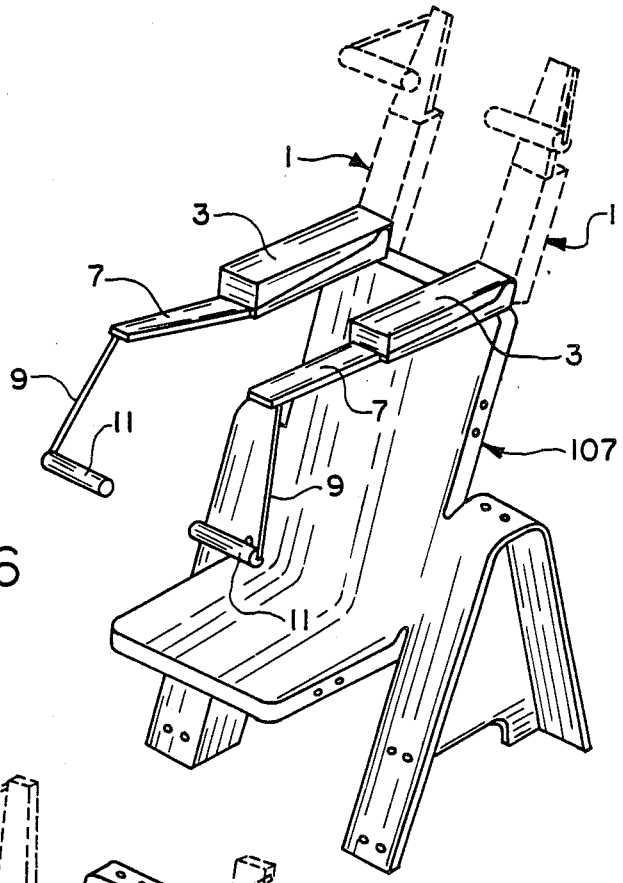

FIG. 26 illustrates how apparatus 1 can be attached to the top of chair 107 by the insertion of pins 13 in receptacles 121, to perform the seated pull down exercise. This is an exercise for strengthening the pectoral and upper abdominal muscles. To perform seated pull downs, the user sits in chair 107 in the usual manner, and grasps handles 11 which are suspended from the vertically extending arms 3 and 7. The user pulls arms 3 forwardly to rotate them about their axes of rotation as discussed previously, overcoming the resistive force of actuators 15 in the process. Apparatus 1 thus moves between the vertical, rest position shown in dotted lines, and the final forward position shown in solid lines.

Figure 27:
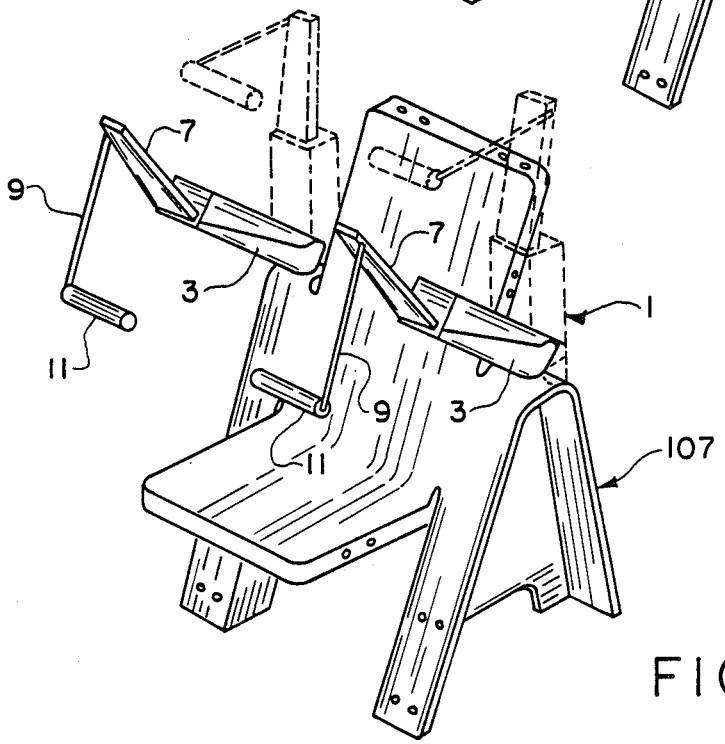

Apparatus 1 can be assembled in receptacles 123 at junctures 117 of the chair legs to enable performance of the seated crunch exercise as shown in FIG. 27. The crunch exercise strengthens the upper and lower abdominal muscles. The user sits in chair 107 in the normal manner, grips handles 11 with the hands, and leans forward with the arms locked. Exercise apparatus 1 are thus moved between the vertical, rest position shown in dotted lines, and the forward, final position shown in solid lines. The movement is done against the pneumatic force of actuators 15 as described previously.

Figure 28:
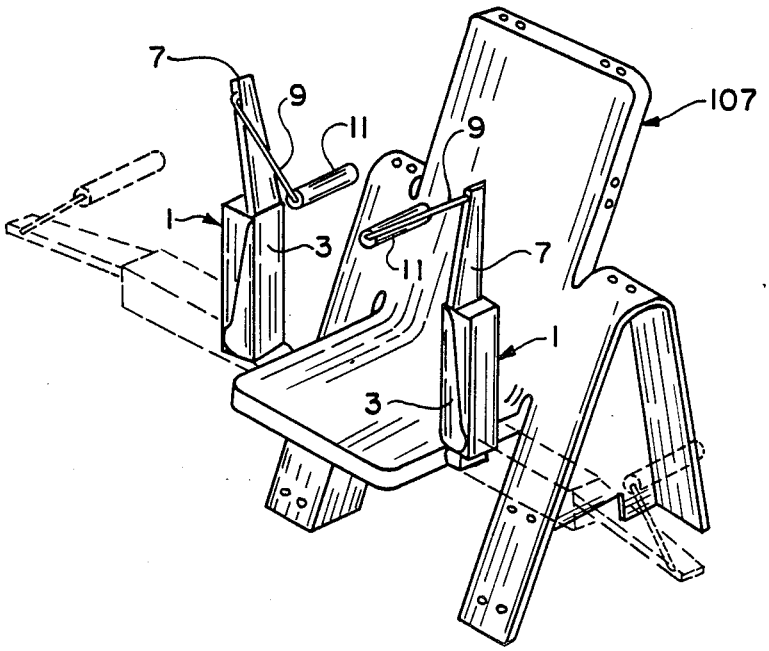

Apparatus 1 can be used to perform the seated curl exercise for strengthening the biceps. Accordingly, mounting pins 13 of apparatus 1 are inserted in receptacles 125 in seat 109 as shown in FIG. 28. In their rest position, arms 3 extend laterally and horizontally from seat 109. The user sits in chair 107 in the normal fashion, grasps handles 11, and rotates apparatus 1 from the rest position shown in dotted lines, to the final, vertical position shown in solid lines. The process is reversed and repeated, with the user resisting the force of actuators 15 urging apparatus 1 to the rest position, to obtain the desired exercise.

Figure 29:
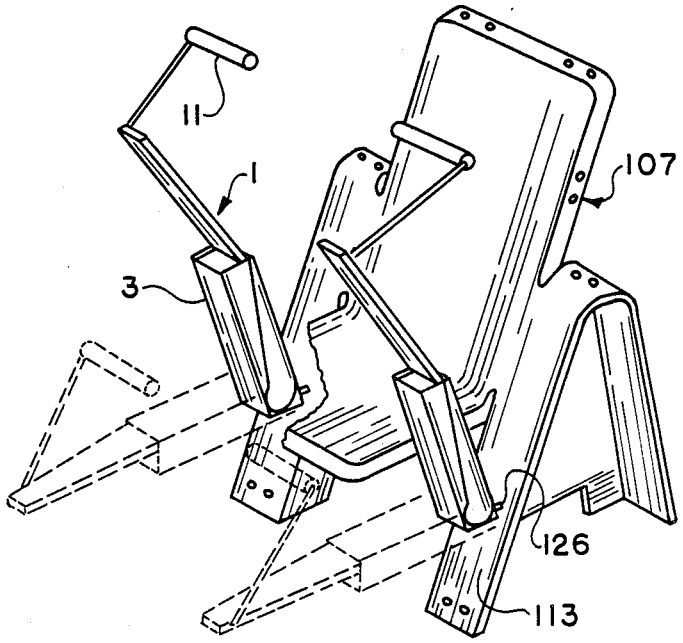

Referring to FIG. 29, chair 107 and apparatus 1 can be used for perform row and curl exercises. Thus, receptacles 126 in each of front legs 113 can be provided for receiving pins 13 of apparatus 1. To perform a rowing exercise the user can lean over, grasp handles 11, and arms 3 from the dotted line position to the solid line position, and then ease the apparatus back to the dotted line position by resisting the return bias or negative resistance of apparatus 1. Similarly, the user can perform a curl exercise by performing the foregoing exercise with only his arms.

Figure 30:
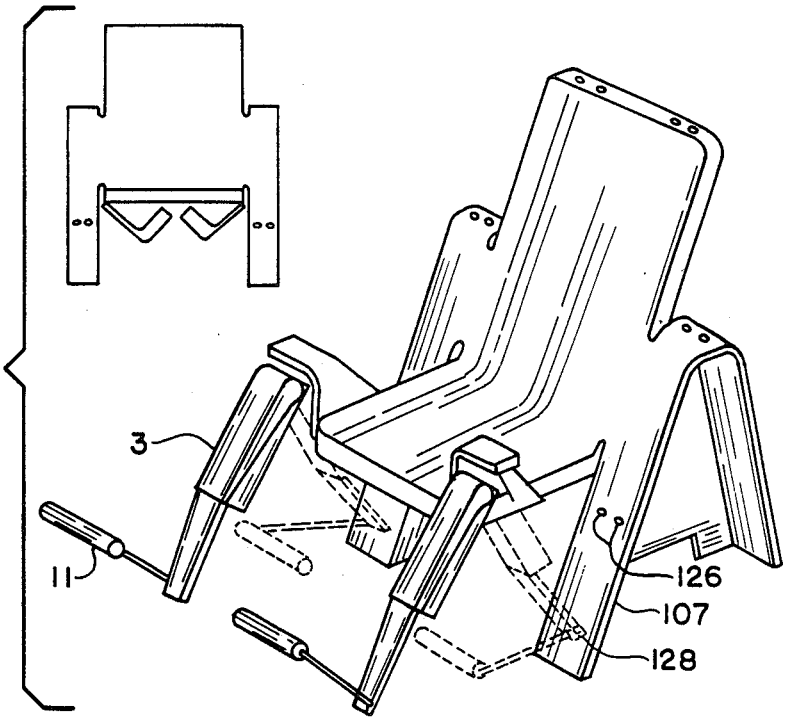

Leg extensions can also be performed using chair 107 and apparatus 1 as shown in FIG. 30. Receptacles 128 are therefore provided in the lower portions of legs 107 for receiving pins 13. The user sits in the chair, places his feet behind handles 11, and raises second arms 3 from the rest position shown in dotted lines to the raised solid line position. Then, against the negative resistance of apparatus 1, the user resists the return bias of the apparatus and eases arms 7 to the rest position.

Figure 31:
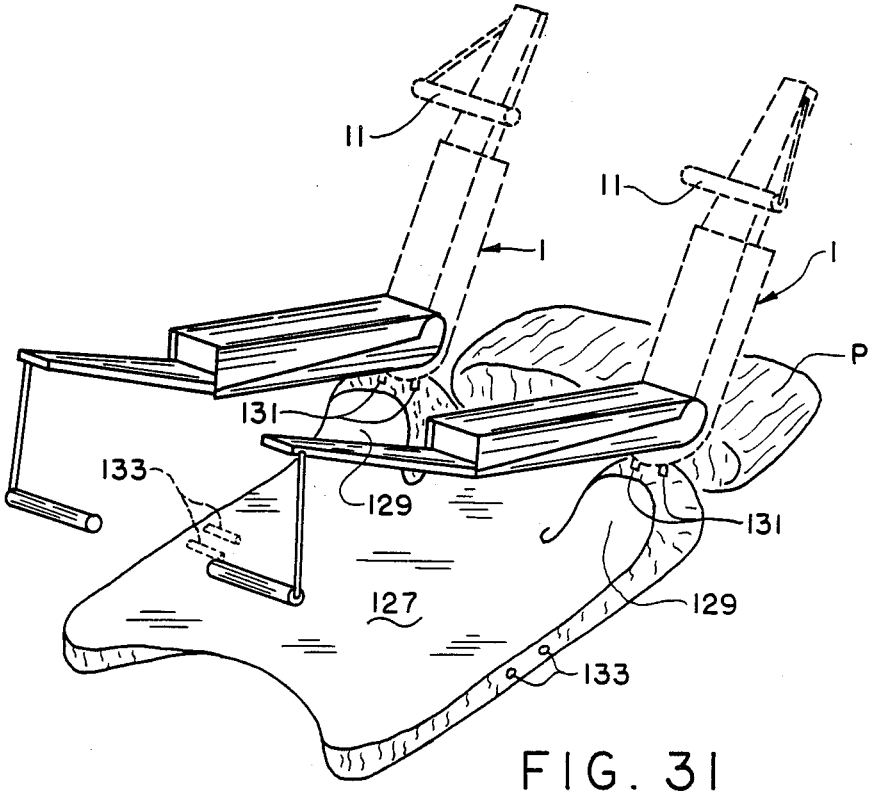
FIG. 31 is a perspective of an exercise system according to another embodiment of the invention used by a bedridden person for performing exercises.

Exercise apparatus according to the invention makes possible physical exercise heretofore unavailable to persons who are bedridden or physically handicapped and confined to wheelchairs or the like. That is, the present invention makes it possible for such persons to engage in a wide range of physical exercises without resort to unwieldly apparatus or especially constructed apparatus. FIGS. 30 and 31 illustrate devices which enable bedridden person to exercise. Thus, a support 127 is provided which can be placed beneath a bedridden person. Support 127 is contoured to receive a person's back, and could be made as molded rigid foam with a smooth covering to facilitate cleaning. Support 127 includes a pair of protrusions 129 on the top of each of which are a first pair of receptacles 131 for receiving mounting pins 13 of apparatus 1. The person in the bed or someone else can easily install apparatus 1 on support 127 by inserting pins 13 of the respective apparatus 1 in receptacles 131. When installed, apparatus 1 extend generally vertically from the support in a rest position shown in dotted lines. In order to perform a pull down exercise similar to that described with reference to FIG. 26, the user lies with his back on the upper surface of support 127 and his head located between protrusions 129 (a pillow P can be provided for added comfort), grasps handles 11, pulls arms 3 down and rotates them 90° to the generally horizontal position shown in solid lines, and then resists the force returning the apparatus to the rest position as discussed earlier.

Opposing pairs of receptacles 133 extend transversely into the sides of support 127, so that apparatus 1 can be installed as shown in FIG. 31 to enable a person in bed to perform the fly exercise. The end positions for the fly position are shown in FIG. 31. The exercise is performed much in the manner discussed with regard to FIGS. 19 and 20, with the user lying with his back and his head between protrusions 131 and optionally resting on pillow P. The user grips handles 11 and moves apparatus 1 from the horizontal position to the vertical position, and then resists the movement of the apparatus back to the horizontal position.

Figure 32:
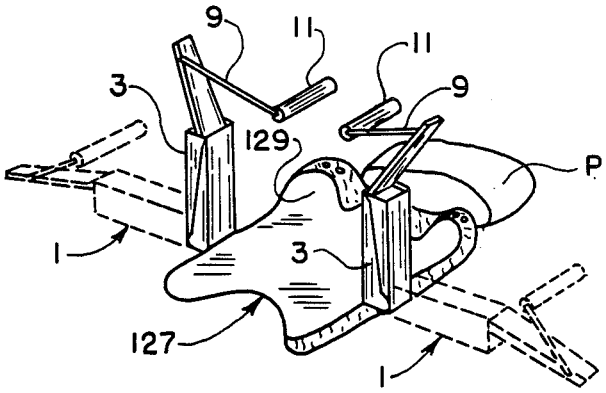
FIG. 32 shows exercise apparatus mounted on such system for performing a fly exercise.
Figure 33:
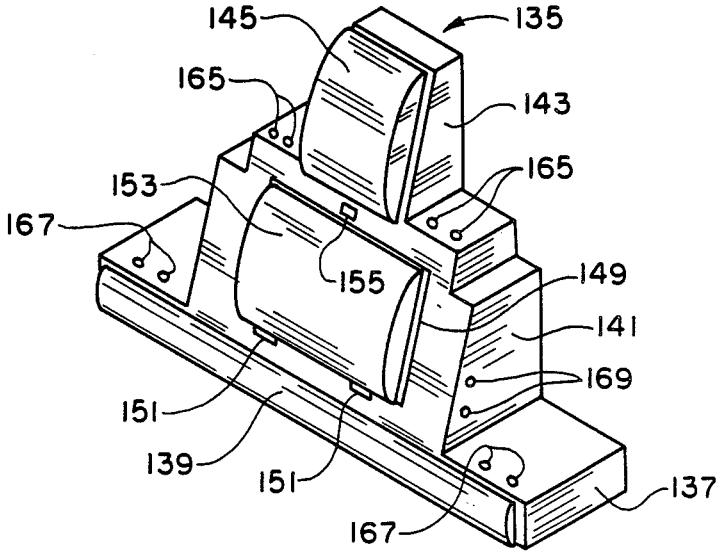
FIG. 33 illustrates in perspective support structure according to the invention for supporting the foregoing exercise apparatus for use by a person in a wheelchair.
Figure 34:
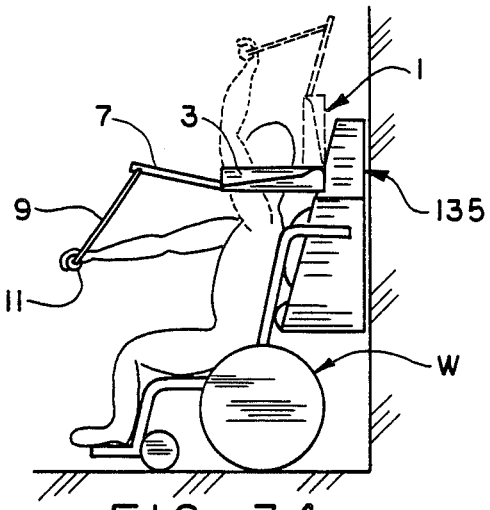
FIGS. 34 and 35 are side views of the exercise apparatus mounted on the foregoing support structure as used by a person in a wheelchair.
Figure 36:
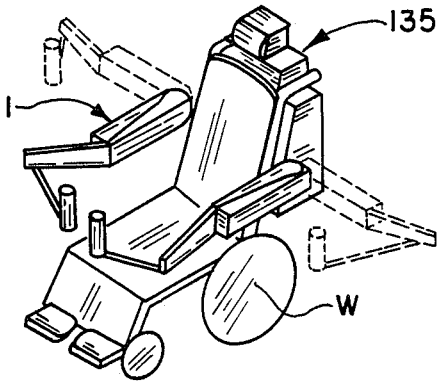
FIG. 36 is a perspective view of the apparatus mounted on a wheelchair for performing the fly exercise.
Figure 37:
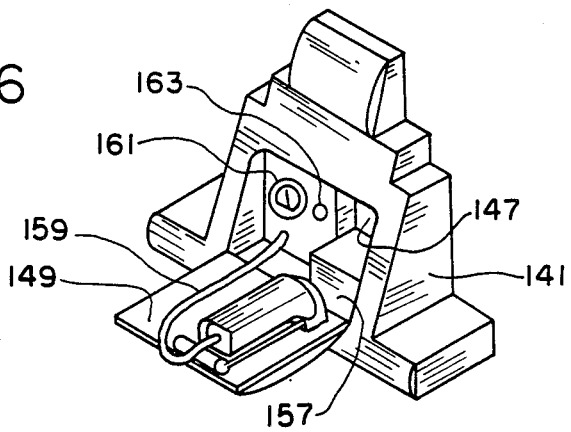
FIG. 37 is a perspective view of the structure shown in FIG. 33 in an open condition.

FIG. 32 shows a wall mountable support member 135 which is constructed to support exercise apparatus 1 for use by a person in a wheelchair. Support 135 includes appropriate means for cooperating with wall structure to mount support 135 on a wall as shown in FIGS. 33 and 34. Support 135 includes a base 137 having a forward face to which is attached a padded chair rest 139, a body portion 141 and a head rest 143 whose forward portion comprises a pad 145. As shown in FIG. 36, a compartment 147 is provided in body portion 141, and a door 149 mounted on hinges 151 selectively opens and closes compartment 141. The forward surface of door 149 forms a padded backrest 153. Door 149 includes a latch mechanism for releasably locking the door in its closed position, and a recessed release button 155 is depressible to unlatch that mechanism. Compartment 147 contains an electric air pump 157 having a hose 159, an air pressure gauge 161 and an air pressure adjustment knob 163 for regulating the pressure of air from the pump.

The foregoing pumping apparatus is used to inject air into air actuator 15 in apparatus 1 in the manner discussed previously regarding the foot pump shown in FIG. 14. When pump 157 is used, button 155 is depressed to release door 149, and the door becomes a shelf for supporting apparatus 1 while filling bag 15 as shown in FIG. 36. Support 135 includes sets of receptacles 165, 167 and 169 for receiving mounting pins 13 to mount apparatus 1 in a variety of exercise stations. In order to set the system up to perform the pulldown exercise as discussed with regard to FIG. 26, mounting pins 13 of apparatus 1 are inserted in respective receptacles so that apparatus 1 in their rest positions extend vertically. A person in a wheelchair W backs the chair against chair rest 139 with his back resting against back rest 153 and his head resting against headrest 145 as shown in FIG. 33. The user reaches up and grasps handles 11 and rotates arms 3 between the raised rest position and the final horizontal position against the resistive force of actuator 15. These positions are shown in dotted and solid lines respectively, in FIG. 32.

Turning next to FIG. 34, this figure shows how apparatus 1 can be assembled in receptacles 167 to perform the abdominal crunch which was discussed previously with regard to FIG. 27. Thus, once apparatus 1 are assembled, the user grasps handles 11 while the apparatus are in their raised rest positions, and bends forward with his arms locked as shown to exercise the abdominal muscles. The exercise is reversed and repeated, with the user resisting the return bias as discussed earlier. The dotted lines show the rest position and the solid lines show the final position.

Figure 35:
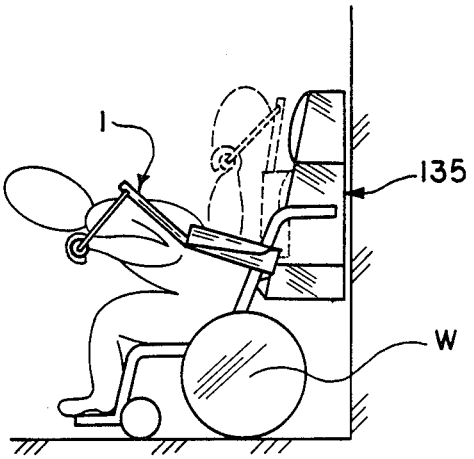

Referring to FIG. 35, apparatus 1 are shown mounted in receptacles 169 to enable the user to move apparatus 1 between the dotted and solid line positions to perform the fly exercise discussed with regard to FIG. 25. The position of wheelchair W with respect to wall-mounted support 135 is the same as discussed with regard to FIGS. 33 and 34.

The foregoing applications of exercise apparatus 1 demonstrate the particularly useful features of the apparatus for those who are physically confined for health reasons. The ease by which the air pressure in the actuator can be adjusted facilitates the use of the apparatus in hospitals and other institutions where persons of varying strengths and physical disabilities could advantageously share a limited number of exercise apparatus. The respective exercise apparatus can be made as very light weight units without sacrificing the desired force range. Even prototypes made from bent rod stocking and formal plastic cover members weighed thirteen pounds or less, as compared for example to conventional weight machines weighing hundreds of pounds. Thus apparatus 1 can in most instances be installed on support structure by the users themselves, or at least by nurses or other attendants.

Apparatus according to the invention enjoy numerous advantages over the cumbersome and heavy exercise devices of the prior art. The exercise apparatus according to the preferred embodiment has been made with an Airsleeve® actuator as discussed above with a maximum resistive operating force of 100 lbs. Which was more than adequate although higher limits are available. The apparatus includes the resistive force device entirely self contained within the exercise arm, rather than externally of the arm as in the prior art. The unit when fully extended was only about 28 inches in length and collapsed to the arrangement shown in FIG. 3 to about 12 inches. Such compactness renders the apparatus, either singly or in pairs, easily portable by travelers since the weight and size are small, and the configuration compact. In addition, exercise apparatus and supports therefor according to the invention can be used in the home, in gymnasiums, health clubs and health care facilities, in motels and hotels and the like. The compact nature of the apparatus makes it feasible to mount and use the apparatus in small spaces such as in motor vehicles, air craft and vessels. Athletes can mount exercise apparatus of the invention in an endless variety of positions to exercise particular muscle groups. Swimmers and various incapacitated persons could use the apparatus under water. The resistance apparatus is easily adjustable, so that for example the apparatus could be adjusted to enable exercise or rehabilitation of an injured limb or other body part. In this regard, a physician or physical therapist could establish and monitor an exercise program with precisely defined resistance values, even in a computer compatible arrangement.

It is significant that the resistive force of the apparatus results from fluid pressure and not from gravity. This makes unnecessary special adjustments to obtain desired force responses to the distance on exercise member (such as a force arm of a machine) is moved. For example, the complex, heavy and expensive cams used in some exercise machines to achieve a uniform resistive force is not necessary with apparatus according to the present invention. Apparatus according to the invention could fin use is environments of little or no gravity, as in space vehicles.

Exercise apparatus according to the invention in its preferred configuration simulates the human arm or leg and follows the motion of the body. This leads to natural movement by the user of the apparatus to render the exercise more effective than prior apparatus relying on arbitrarily arranged linkages, pulleys, chains, cables and the like.

The ability to use one support member for a full range of exercises using apparatus according to the invention makes the arrangement very economical. There have recently been introduced into the market place machines for exercising but a single muscle group such as the biceps. In order for a person to exercise a large number of muscles, a number of such machines would be necessary. The cost and space requirements for such a number of machines make such a concept impractical and expensive. By contrast, a pair of exercise apparatus and a single support (such as a chair or wall unit adapted to receive the exercise apparatus) according to the invention make it entirely feasible for individuals to effectively perform a wide range of exercises.

The preferred embodiment of the invention has been described as incorporating a pneumatic actuator, and in particular to the Airstroke® actuator. However, the invention is not restricted to such device. The term fluid actuator as used within the context of the invention refers to a fluid in a container which exerts pressure resulting in a resistive force in response to the movement such as a piston against the fluid.

The invention has been described in detail with particular emphasis on the preferred embodiments, but it should be understood that variations and modifications within the spirit and scope of the invention may occur to those skilled in the art.

I claim:

1. Exercise apparatus for exercising selected muscles of the body, said apparatus comprising:

air actuator means for generating resistive forces in response to externally applied forces, said air actuator means including air tight bag means for containing air and having a relatively expanded condition and a relatively collapsed condition wherein said bag means in collapsed within itself, and piston means movable in response to externally applied forces to drive said bag means between the expanded condition and the collapsed condition for compressing the air according to the extent of collapse of said bag means;

said air tight bag means includes a base, and a tubular-flexible bag hermetically sealed at one end to said base and hermetically sealed at a second end to said piston means, to define a sealed chamber for holding a quantity of air sealed in said chamber; and driving means operatively connected to said piston means for moving said piston means to drive said bag means in response to the externally applied forces;

said driving means includes connecting means pivotally attached to said base and to said piston means, and arm means operatively connected to said air actuator means to urge said piston means against said connecting means in response to the application of the external forces to said driving means to drive said piston means into said chamber to compress the air in said chamber, the pressure applied by the air against said piston means generating the resistive force;

said arm means comprises first arm means for supporting said air actuator means, said first arm means being pivotally attached to said base and having a first axis of rotation and said connecting means being pivotally attached to said base and having a second axis of rotation spaced from said first axis of rotation, said first arm means rotating said actuator means about said first axis of rotation to rotate said connecting means about said second axis of rotation to drive said piston means to compress the air in said chamber, in response to the application of external forces to said driving means; and, second arm means connected to said first arm means, said second arm means having a first condition wherein said second arm means is connected to said first arm means for rotating said first arm means about said first axis of rotation and said second arm means being movable to a second condition for folding said second arm means to collapse said exercise apparatus.

2. The invention according to claim 1 wherein said arm means further comprises third arm means pivotally connected to said second arm means having handle means engageable by a user of said exercise apparatus to adjust the effective length of said first and second arm means according to the arm length of the user.

3. Exercise apparatus for exercising selected muscles of the body, said apparatus comprising:

fluid actuator means for generating resistive forces in response to externally applied forces, said fluid actuator means including:

a base;

a bag having two open ends, said bag being hermetically sealed at one of said ends to said base;

piston means hermetically sealed to the second end of said bag;

said base, bag and piston defining a sealed chamber for containing a quantity of air; and driving means operatively connected to said piston means for moving said piston means against the quantity of air in response to the externally applied forces; said driving means including:

connecting means pivotally attached to said base and to said piston means; and arm means including first arm means and second arm means connected to said first arm means;

said first arm means being pivotally attached to said base and having a first axis of rotation and said connecting means being pivotally attached to said base and having a second axis of rotation spaced from said first axis of rotation, said first arm means rotating said actuator means about said first axis of rotation to rotate said connecting means about said second axis of rotation to drive said piston means to compress the air in said chamber, in response to the application of external forces to said driving means; and said second arm means having a first condition wherein said second arm means is connected to said first arm means for rotating said first arm means about said first axis of rotation and said second arm means being movable to a second condition for folding said second arm means to collapse said exercise apparatus.

4. The invention according to claim 3 wherein said arm means further comprising third arm means, said third arm means having handle means engageable by a user of said exercise apparatus to adjust the effective length of said first arm means according to the arm length of the user.

5. The invention according to claim 4 wherein said third arm means comprises an arm mounted for pivotal movement relative to said first arm means.

6. The invention according to claim 4 wherein said arm means further comprises third arm means pivotally connected to said second arm means having handle means engageable by a user of said exercise apparatus to adjust the effective length of said first and second arm means according to the arm length of the user.

* * * * *